US011639064B2

(12) United States Patent
Saiga et al.

(10) Patent No.: US 11,639,064 B2
(45) Date of Patent: May 2, 2023

(54) IMAGE FORMING METHOD

(71) Applicants: Takuya Saiga, Kanagawa (JP); Hidetoshi Fujii, Kanagawa (JP); Shigeyuki Harada, Shizuoka (JP); Yuya Hirokawa, Kanagawa (JP)

(72) Inventors: Takuya Saiga, Kanagawa (JP); Hidetoshi Fujii, Kanagawa (JP); Shigeyuki Harada, Shizuoka (JP); Yuya Hirokawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 44 days.

(21) Appl. No.: 17/505,697

(22) Filed: Oct. 20, 2021

(65) Prior Publication Data

US 2022/0126605 A1 Apr. 28, 2022

(30) Foreign Application Priority Data

Oct. 23, 2020 (JP) ..... JP2020-178114
Jul. 26, 2021 (JP) ..... JP2021-121280

(51) Int. Cl.
*B41J 11/00* (2006.01)

(52) U.S. Cl.
CPC ..... *B41J 11/00214* (2021.01)

(58) Field of Classification Search
CPC ..... B41J 11/00214; B41J 11/0022
See application file for complete search history.

(56) References Cited

U.S. PATENT DOCUMENTS

| | | | | |
|---|---|---|---|---|
| 2017/0355868 | A1 | 12/2017 | Saiga et al. | |
| 2019/0264050 | A1 | 8/2019 | Harada et al. | |
| 2019/0270901 | A1 | 9/2019 | Fujii et al. | |
| 2019/0276694 | A1* | 9/2019 | Yamazaki | B41J 2/01 |
| 2020/0002558 | A1 | 1/2020 | Iwasaki et al. | |
| 2020/0032084 | A1 | 1/2020 | Fujii | |
| 2020/0263049 | A1 | 8/2020 | Harada et al. | |
| 2020/0277505 | A1 | 9/2020 | Yamazaki et al. | |
| 2021/0079243 | A1 | 3/2021 | Fujii | |

FOREIGN PATENT DOCUMENTS

| | | | |
|---|---|---|---|
| JP | 2007-083565 | | 4/2007 |
| JP | 2019-518812 | | 7/2019 |
| WO | WO2009/128833 | A1 | 10/2009 |
| WO | WO2014/033657 | A1 | 3/2014 |
| WO | WO2017/180637 | A1 | 10/2017 |

* cited by examiner

*Primary Examiner* — Bradley W Thies
(74) *Attorney, Agent, or Firm* — Grüneberg and Myers PLLC

(57) ABSTRACT

An image forming method includes discharging ink containing water, a coloring material, a polymerization initiator, and a polymerizable compound to a recording medium by a line head to obtain an image, exposing the image to active energy radiation, applying a processing fluid to the image, and drying the image with heat, wherein the time interval between when the ink is discharged in the discharging from the line head to the recording medium passing under a bottom portion of the line head and when the recording medium is exposed to the active energy radiation in the exposing is from 0.5 to 15 seconds.

11 Claims, 7 Drawing Sheets

IMAGE FORMING METHOD

CROSS-REFERENCE TO RELATED APPLICATIONS

This patent application is based on and claims priority pursuant to 35 U.S.C. § 119 to Japanese Patent Application Nos. 2020-178114 and 2021-121280, filed on Oct. 23, 2020 and Jul. 26, 2021, respectively, in the Japan Patent Office, the entire disclosures of which are hereby incorporated by reference herein.

BACKGROUND

Technical Field

The present invention relates to an image forming method.

Description of the Related Art

One way of image forming methods is inkjet printing. This method has become rapidly popular because it can readily print color images with low running cost. Inkjet printing is now widely used in commercial and industrial settings. The technology development is now focused on high performance printing using a line head with a single pass to increase the productivity.

One type of inkjet printing inks for use in inkjetting is an aqueous ink, in which a pigment is dispersed in an aqueous medium. The aqueous ink using water-dispersible pigment ink is known to have excellent light resistance in comparison with ink using dye.

However, when a pigment ink is used for printing on low absorptive media such as gloss-treated coated paper, the pigment as coloring material remains on the surface, forming a film. Therefore, printing with pigment ink on such low absorptive media is inferior with regard to abrasion resistance of the print surface to printing with pigment ink on plain paper or printing with dye ink, which permeates the inside of an ink-receiving layer. This is because it causes such problems to a print surface as peeling off of print film, expansion of the print film to non-printed portion, and smudge by peeled-off matter when the print surface is rubbed after printing. Also, controlling the film thickness and the degree of leveling is difficult, which results in degradation of the image quality, in particular, glossiness.

SUMMARY

According to embodiments of the present disclosure, provided is an image forming method which includes discharging ink containing water, a coloring material, a polymerization initiator, and a polymerizable compound to a recording medium by a line head to obtain an image, exposing the image to active energy radiation, applying a processing fluid to the image, and drying the image with heat, wherein the time interval between when the ink is discharged in the discharging from the line head to the recording medium passing under a bottom portion of the line head and when the recording medium is exposed to the active energy radiation in the exposing is from 0.5 to 15 seconds.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
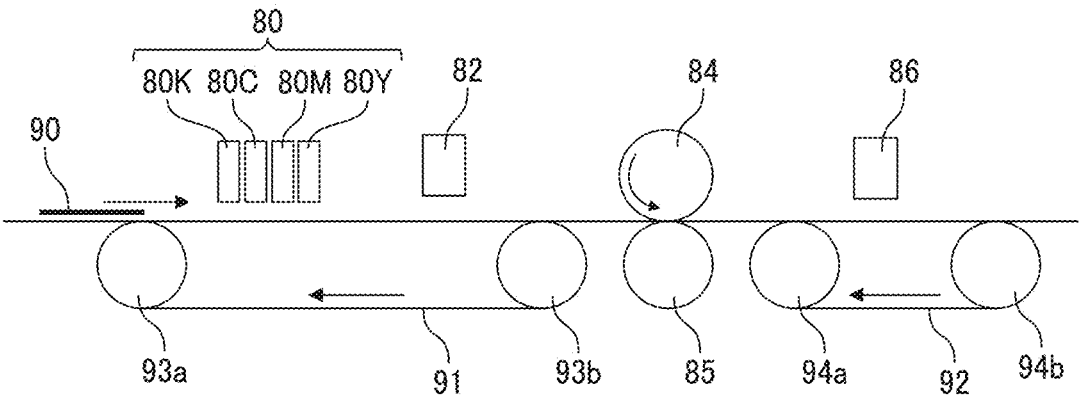
FIG. 1 is a diagram illustrating an example of the printing device for executing the image forming method according to an embodiment of the present disclosure.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc., in the present disclosure represent the same meaning, unless otherwise specified.

Embodiments of the present invention are described in detail below with reference to accompanying drawing(s). In describing embodiments illustrated in the drawing(s), specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In an attempt to secure the abrasion resistance, an ink has been developed by allowing radical reaction between a radical reactive material having an acrylate structure in a part of the structure and an ink containing pigment particles.

A method of applying overcoat processing fluid containing resin to the surface of ink film has also been proposed in an attempt to enhance the abrasion resistance.

However, this method blurs an image when overcoat processing fluid is applied to ink film to enhance the productivity immediately after printing. In the case of active energy radiation curing material mainly consisting of water, image forming by inkjetting and application of overcoat processing fluid respectively require drying and curing, which degrades the productivity.

According to the present disclosure, an image forming method is provided which enhances productivity, abrasion resistance, anti-blurring of image, and glossiness.

Hereinafter, the image forming method relating to the present disclosure is described with reference to the accompanying drawings. It is to be noted that the following embodiments are not limiting the present disclosure and any deletion, addition, modification, change, etc. can be made within a scope in which man in the art can conceive including other embodiments, and any of which is included within the scope of the present disclosure as long as the effect and feature of the present disclosure are demonstrated.

The image forming method of the present disclosure includes discharging ink containing water, a coloring material, a polymerization initiator, and a polymerizable compound to a recording medium by a line head to obtain an image, exposing the image to active energy radiation, applying a processing fluid to the image, and drying the image with heat, wherein the time interval between when the ink is discharged in the discharging from the line head to the recording medium that is passing under the bottom portion of the line head and when the recording medium is exposed to the active energy radiation in the exposing is from 0.5 to 15 seconds.

Image Forming Method

One embodiment of the image forming method of the present disclosure is described below.

FIG. 1 is a diagram illustrating an example of the recording or printing device for executing the image forming method according to the present embodiment of the present disclosure. The image forming method of the present embodiment includes at least ink discharging, exposing to active energy radiation, applying processing fluid, and drying. The method executes these processes in this order.

FIG. 1 illustrates an inkjet head 80 for use in the ink discharging, an active energy radiation irradiator 82 for use in the active energy radiation exposing (irradiation), a processing fluid application roller 84 and a facing roller 85 for use in the processing fluid application, and a heated wind heater (drier) 86 for use in the drying. A recording medium 90 is conveyed by convey rollers 93*a*, 93*b*, 94*a*, and 94*b*, and a conveyor belts 91 and 92. The arrows in FIG. 1 indicate the conveyance direction of the recording medium 90, the rotation direction of the processing fluid application roller 84, and the rotation direction of the conveyor belts 91 and 92. The recording medium 90 is fed from a feeding unit.

In the present embodiment, as illustrated in FIG. 1, ink is discharged to the recording medium 90 in accordance with an image pattern in the ink discharging process.

Thereafter, the ink cures when the image is exposed to active energy radiation in the active energy radiation irradiation. The time interval between the ink discharging and the active energy radiation irradiation is arranged as described later. This time interval makes it possible to prevent ink from blurring even for high performance printing when processing fluid is applied in the processing fluid application.

It is not necessary to completely cure the ink in the active energy radiation. Just prevention of ink blurring will suffice.

In the present embodiment, the time interval is from 0.5 to 15 seconds. This time interval is also referred to as interval between the ink discharging and the active energy radiation irradiation.

An interval of 0.5 seconds or more covers the image region and merges ink dots, thereby forming a uniform ink film, which enhances glossiness. Since the number of points which cause peeling of film decreases due to dot merger and leveling, image robustness is improved.

An interval of 15 seconds or less prevents ink from excessively covering an image region or permeating a media, thereby minimizing blurring.

The interval is preferably from 0.5 to 10 seconds. In this region, the productivity is improved and blurring can be prevented.

Next, processing fluid is applied in the processing fluid application. The application of processing fluid forms a processing fluid layer having excellent abrasion resistance and glossiness on the surface of an image. This layer provides images having excellent abrasion resistance and glossiness In the drying, the ink and the processing fluid are dried with heat. A film of processing fluid is formed with tightly attached to ink during this drying, creating an image with excellent abrasion resistance.

The recording medium is not particularly limited. Materials such as plain paper, gloss paper, special paper, and cloth are usable. Also, good images can be formed on a non-permeable substrate.

The non-permeable substrate has a surface with low moisture permeability and absorbency and includes a material having a number of hollow spaces inside that are not open to the outside. To be more quantitative, the substrate has a water-absorbency of 10 or less $mL/m^2$ from the start of the contact until 30 $msec^{1/2}$ later according to Bristow's method.

For example, plastic films such as vinyl chloride resin film, polyethylene terephthalate (PET) film, polypropylene film, polyethylene film, and polycarbonate film are suitably used as the non-permeable substrate.

Ink for use in the ink discharging and processing fluid for use in the processing fluid application can be suitably selected. Ink for use in the ink discharging and processing fluid for use in the processing fluid application preferably satisfy the following requisites.

An ink film prepared by the following method preferably has a swelling ratio of 30 percent or less after the ink film is dipped in processing fluid at 100 degrees C. for one hour.

"Mass" means the mass of ink film.

$$\text{Swelling ratio}=\{(\text{mass after dipping})-(\text{mass before dipping})\}/(\text{mass before dipping})\times 100$$

Method of Manufacturing Ink Film

A total of 5.0 g of the ink is placed in a Teflon™ Petri dish having a diameter of 50 mm and exposed to ultraviolet (UV) radiation at an integral of light of 17 $mJ/cm^2$ followed by drying at 100 degrees C. for 12 hours.

Since a swelling ratio of 30 percent or less minimizes swelling or dissolution of ink film by the processing fluid mentioned above when the fluid is applied, images free of ink blurring are created even when the processing fluid is applied in the processing fluid application.

The swelling ratio is more preferably 20 percent or less.

Materials and amounts are suitably changed to prepare ink or processing fluid having a swelling ratio of 30 percent or less.

The ink film preferably has a contact angle of 30 degrees or less, more preferably from 10 to 20 degrees 5 seconds after a drop of the processing fluid is deposited on the ink film. A contact angle of 10 degrees or more prevent processing fluid from permeating ink film, which is preferable to minimize ink blurring. A contact angle of 30 degrees or less forms a uniform processing fluid layer because the processing fluid sufficiently covers ink film, thereby enhancing glossiness.

Method of Preparing Ink Film

A total of 5.0 g of the ink is placed in a Teflon™ Petri dish having a diameter of 50 mm and exposed to UV radiation at an integral of light of 17 mJ/cm$^2$ followed by drying at 100 degrees C. for 12 hours.

Ink Discharging

In the ink discharging, a discharging device discharges ink (also referred to as inkjet ink) to a recording medium to form images. The ink is discharged from discharging pores (nozzles, head nozzles) of the discharging device and reaches the recording medium. The ink discharging is also referred to as ink printing.

Inkjet heads (printing heads, recording heads) are used in the ink discharging. In the present embodiment, ink is discharged by a line head as the discharging device. Line heads are fixed at predetermined positions while discharging ink to the recording medium. The medium is continuously moving.

The inkjet head is not particularly limited. Two ways of inkjet head inkjetting ink are continuous spraying and on-demand discharging. On-demand discharging includes a piezo method, thermal method, and electrostatic method. The piezo method is preferable in terms of discharging reliability.

The droplet size of ink discharged is preferably from 1 to 30 pL. The spraying speed of discharging is preferably from 5 to 20 m/s. The drive frequency is preferably 1 kHz or more. The resolution is preferably 300 dpi or more.

The discharging device of the present embodiment has one or more inkjet heads.

The inkjet head may combine with other members to form a printing unit. As illustrated in FIG. 1, multiple inkjet heads using different types of inks such as black (K), cyan (C), magenta (M), and yellow (Y) can be configured. Inkjet heads have a number of nozzles and discharge ink turned into droplets by energy.

An inkjet head includes members such as a liquid chamber, liquid resistance, diaphragm, nozzle member, and energy generating member. The nozzle member includes nozzles and the liquid chamber is communicated with the nozzles. The diaphragm vibrates by the energy generating member, so that the ink in the liquid chamber from the nozzles is discharged. It is preferable that the inkjet head at least partially be made of materials containing silicone or nickel.

The nozzle diameter is preferably 30 μm or less and more preferably from 1 to 20 μm.

Ink

The ink for use in the present disclosure contains water, a coloring material, a polymerization initiator, a polymerizable compound, and other optional components.

Water

The proportion of water in the ink is not particularly limited and can be suitably selected to suit to a particular application; it is preferably from 10 to 90 percent by mass and more preferably from 20 to 80 percent by mass to enhance the drying property and discharging reliability of the ink.

Coloring Material

Pigments and dyes are added as the coloring material in accordance with the objectives and requisites to demonstrate black, white, magenta, cyan, yellow, green, orange, and gloss color such as gold and silver. The proportion of the coloring material is not particularly limited and determined considering the desired color density and dispersibility of the coloring material in a curing composition. It is preferable that the proportion of the coloring material account for 0.1 to 20 percent by mass of the total content (100 percent by mass) of ink.

An inorganic or organic pigment can be used alone or in combination as the pigment.

Specific examples of the inorganic pigment include, but are not limited to, carbon blacks (C.I. PIGMENT BLACK 7) such as furnace black, lamp black, acetylene black, and channel black, iron oxides, and titanium oxides.

Specific examples of the organic pigment include, but are not limited to, azo pigments such as insoluble azo pigments, condensed azo pigments, azo lakes, chelate azo pigments, polycyclic pigments such as phthalocyanine pigments, perylene pigments, perinone pigments, anthraquinone pigments, quinacridone pigments, dioxazine pigments, thioindigo pigments, isoindolinone pigments, and quinofuranone pigments, dye chelates such as basic dye type chelates, acid dye type chelates, dye lakes such as basic dye type lake and acid dye type lake, nitro pigments, nitroso pigments, aniline black, and daylight fluorescent pigments.

In addition, a dispersant is optionally added to enhance dispersibility of a pigment. The dispersant has no particular limit. For example, it is suitable to use a polymer dispersant conventionally used to prepare a pigment dispersion.

The dye includes, for example, an acidic dye, direct dye, reactive dye, basic dye, and a combination thereof.

Polymerization Initiator

The polymerization initiator is not particularly limited as long as it produces active species such as a radical or a cation upon an application of energy of active energy radiation to initiate polymerization of a polymerizable compound (monomer or oligomer). As the polymerization initiator, it is suitable to use a known radical polymerization initiator, a cation polymerization initiator, a base producing agent, or a combination thereof. Of these, radical polymerization initiators are preferable. Moreover, the polymerization initiator preferably accounts for 5 to 20 percent by mass of the total content (100 percent by mass) of ink to achieve a sufficient curing speed.

Specific examples of the radical polymerization initiators include, but are not limited to, aromatic ketones, acylphosphineoxide compounds, aromatic oniumchlorides, organic peroxides, thio compounds (thioxanthone compounds, compounds including thiophenyl groups, etc.), hexaarylbiimidazole compounds, ketoxime-esterified compounds, borate compounds, azinium compounds, metallocene compounds, active ester compounds, compounds having a carbon halogen bond, and alkylamine compounds.

In addition, a polymerization accelerator (sensitizer) can be optionally used together with the polymenzation initiator. The polymerization accelerator is not particularly limited. Preferred examples thereof include, but are not limited to, amine compounds such as trimethylamine, methyldimethanolamine, triethanolamine, p-diethylaminoacetophenone, p-dimethylaminoethylbenzoate, p-dimethyl aminobenzoate-2-ethylhexyl, N,N-dimthylbenzylamine, and 4,4'-bis(diethylamino)benzophenone. The content can be suitably determined to suit to the identification and the content of the polymerization initiator used in combination with the polymerization accelerator.

Polymerizable Compound

The polymerizable compound optionally contains a dispersion having a polymerizable group, a polymerizable monomer, and other materials.

Dispersion Having Polymerizable Group (Reactive Dispersion)

A dispersion having a polymerizable group is reactive. It can be polymerized with other particles upon a stimulus such as ultraviolet radiation and heat. Due to inclusion of a dispersion having a polymerizable group in a curable composition, cured film obtained by curing the curable composition can have excellent smoothness (glossiness), flexibility, and abrasion resistance.

The dispersion having a polymerizable group has no specific limit and can be suitably selected to suit to a particular application. For example, a dispersion having a water-dispersible polymerizable group is suitable. An example of the dispersion having a water-dispersible polymerizable group is a reactive polyurethane particle. A specific example of the reactive polyurethane particles is a (meth) acrylated polyurethane particle.

The (meth)acrylated polyurethane particle is procurable.

Specific examples include, but are not limited to. Ucercoat™ 6558, Ucercoat™ 6569, Ebecryl™ 2002, Ebecryl™ 2003, Ucercoat™ 7710, and Ucercoat™ 7655 (all manufactured by DAICEL-ALLNEX LTD.), NeoradR™ 440, NeoradR™ 441, NeoradR™ 447, NeoradR™ 448, Bayhydrol™ UV2317, and Bayhydrol™ UV VP LS2348 (all manufactured by Covestro AG), Lux™ 430, Lux™ 399, and Lux™ 484 (all manufactured by Alberding Boley), Laromer™ LR8949, Laromer™ LR8983, Laromer™ PE22WN, Laromer™ PE55WN, and Laromer™ UA9060 (all manufactured by BASF SE).

Of these, Laromer™ LR8949 and Laromer™ LR8983 are preferable. These particles enhance the abrasion resistance of cured film.

The proportion of the dispersion having a polymerizable group in the total content of the composition is preferably from 2 to 12 percent by mass and more preferably from 6 to 12 percent by mass in solid form.

When the proportion of the dispersion having a polymerizable group is from 2 to 12 percent by mass, the abrasion resistance can be enhanced.

Polymerizable Monomer

The polymerizable monomer is not particularly limited as long as it has a reactive substituent capable of conducting a polymerization reaction, and can be suitably selected to suit to a particular application.

As the polymerizable monomer, for example, (meth) acrylate, (meth)acrylamide, and vinyl ether can also be used in combination.

Specific examples include, but are not limited to, ethylene glycol di(meth)acrylate, hydroxypivalate neopentyl glycol di(meth)acrylate, γ-butyrolactone acrylate, isobornyl (meth) acrylate, formalized trimethylolpropane mono(meth)acrylate, polytetramethylene glycol di(meth)acrylate, trimethylolpropane (meth)acrylic acid benzoate, triethylene glycol di(meth)acrylate, tetraethylene glycol di(meth)acrylate, polyethylene glycol diacrylate [$CH_2{=}CH{-}CO{-}(OC_2H_4)_n{-}OCOCH{=}CH_2$ (n≈4)], polyethylene glycol diacrylate [$CH_2{=}CH{-}CO{-}(OC_2H_4)_n{-}OCOCH{=}CH_2$ (n≈9)], polyethylene glycol diacrylate [$CH_2{=}CH{-}CO{-}(OC_2H_4)_n{-}OCOCH{=}CH_2$(n≈14)], polyethylene glycol diacrylate [$CH_2{=}CH{-}CO{-}(OC_2H_4)_n{-}OCOCH{=}CH_2$ (n≈23)], dipropylene glycol di(meth)acrylate, tripropylene glycol di(meth)acrylate, polypropylene glycol dimethacrylate [$CH_2{=}C(CH_3){-}CO{-}(OC_3H_6)_n{-}OCOC(CH_3){=}CH_2$(n≈7)], 1,3-butanediol di(meth)acrylate, 1,4-butanediol diacrylate, 1,6-hexanediol di(meth)acrylate, 1,9-nonanediol di(meth)acrylate, neopentyl glycol diacrylate, tricyclodecane dimethanol diacrylate, propylene oxide modified bisphenol A di(meth)acrylate, polyethylene glycol di(meth)acrylate, dipentaerythritol hexa(meth)acrylate, (meth)acryloyl morpholine, propylene oxide modified tetramethylol methane tetra(meth)acrylate, dipentaerythritol hydroxy penta(meth)acrylate, caprolactone modified dipentaerythritol hydroxy penta(meth)acrylate, ditrimethylolpropane tetra(meth)acrylate, pentaerythritol tetra(meth)acrylate, trimethylolpropane triacrylate, ethylene oxide modified trimethylolpropane tri(meth)acrylate, propylene oxide-modified trimethylolpropane tri(meth)acrylate, caprolactone modified trimethylolpropane tri(meth)acrylate, pentaerythritol tri(meth)acrylate, tris(2-hydroxyethyl)isocyanurate tri (meth)acrylate, neopentyl glycol diacrylate, ethoxylated neopentyl glycol di(meth)acrylate, propylene oxide modified neopentyl glycol di(meth)acrylate, propylene oxide modified glyceryl tri(meth)acrylate, polyester di(meth)acrylate, polyester tri(meth)acrylate, polyester tetra(meth)acrylate, polyester penta(meth)acrylate, polyester poly(meth) acrylate, polyurethane di(meth)acrylate, polyurethane tri (meth)acrylate, polyurethane tetra(meth)acrylate, polyurethane penta(meth)acrylate, polyurethane poly(meth) acrylate, 2-hydroxypropyl(meth)acrylamide, N-vinylcaprolactam, N-vinylpyrrolidone. N-vinyl formamide, cyclohexanedimethanol monovinyl ether, cyclohexane dimethanol divinyl ether, hydroxyethyl vinyl ether, diethylene glycol monovinyl ether, diethylene glycol divinyl ether, dicyclopentadiene vinyl ether, tricyclodecane vinyl ether, benzyl vinyl ether, and ethyl oxetane methyl vinyl ether.

Of these, it may be selected and added in consideration of the solubility in water as the dispersion medium, the viscosity of the composition, the thickness of the cured film (coated film) on the substrate, etc. In terms of the solubility in water, acryloyl morpholine, dimethylaminopropyl acrylamide, polyethylene glycol, or polypropylene glycol-modified acrylate is preferable. These can be used alone or in combination.

Active Energy Radiation Irradiation

The active energy radiation for use in the active energy radiation irradiation is not particularly limited as long as it applies energy required to allow the polymerization reaction of the polymerizable components in the curable composition. Specific examples include, but are not limited to, electron beams, α radiation, β radiation, γ radiation, and X radiation, in addition to ultraviolet radiation. Ultraviolet radiation is preferable to enhance curability.

Specific examples of the ultraviolet light source used as the curing device (active energy radiation irradiation device) include, but are not limited to, a low-pressure mercury lamp, high-pressure mercury lamp, metal halide lamp, a hot cathode tube, a cold cathode tube, and a light emitting diode. Of these, using a metal halide lamp is preferable and effective to cure a pre-processing fluid because it has a wide range of wavelength. Metal halides of metal such as Pb, Sn, and Fe are used. They are selected in accordance with absorption spectrum of a polymerization initiator.

It is possible to use any effective lamp without a particular limitation. Since UV irradiation lamps generates heat, a recording medium is possibly deformed. They preferably have a cooling mechanism such as a cold mirror, cold filter, and work cooling.

In the case of an ultraviolet radiation irradiator, the luminosity (lamp strength, lamp brightness) is preferably from 0.1 to 15 W/cm$^2$ to enhance curability.

When UV-A is used in the active energy radiation irradiation, the integral of light of UV-A is preferably from 17 to 2,000 mJ/cm$^2$ and more preferably from 200 to 2,000 mJ/cm$^2$. An integral of light of 17 mJ/cm$^2$ or greater sufficiently cures ink film and prevents blurring upon an application of processing fluid. An integral of light of 2,000 mJ/cm$^2$ or less minimizes an adverse impact on a recording medium such as burning.

Processing Fluid Application

The processing fluid application process is to apply processing fluid to an image after the active energy radiation irradiation. The processing fluid for use in the processing fluid application is also referred to as overcoat processing fluid. The processing fluid is applied to the print surface of a recording medium on which an image is formed after the active energy radiation irradiation and before the drying. The portion where the processing fluid is applied is all or part of the image formed on a recording medium, which is selected to suit to a particular application.

The method of applying processing fluid is suitably selected. One way of applying processing fluid is to use an applying device.

There is no specific limitation to the applying device, which can be suitably selected to suit to a particular application.

Specific examples include, but are not limited to, liquid film coating devices such as a roll coater, flexo coater, rod coater, blade, wire bar, air knife, curtain coater, slide coater, doctor knife, screen coater, gravure coater (such as offset gravure coater), slot coater, and extrusion coater.

Such devices employ known methods such as forward and backward roll coating, offset gravure, curtain coating, lithographic coating, screen coating, and gravure coating. Of these, a roll coater, flexo coater, and gravure coater are preferable to adjust the amount of processing fluid applied.

In the processing fluid application, using a roller is preferable. It is more preferable to apply processing fluid to a recording medium by a roller in a contact manner. The use of a roll coater is particularly preferable as illustrated in FIG. 1. The amount of processing fluid applied is readily adjusted by a roller as described above.

When processing fluid is applied by a roller, the roller preferably rotates forward in accordance with the conveyance of a recording medium. When a roller rotates forward, processing fluid can be evenly applied without scratching the surface of a recording medium, which minimizes a peeling or a sign of peeling on an image.

There is no specific limitation to the thickness of processing fluid, which can be suitably selected to suit to a particular application. The thickness is preferably from 1 to 200 μm, more preferably from 5 to 150 μm, and most preferably from 10 to 100 μm. A thickness of 1 μm or more minimizes repulsion of processing fluid, thereby enhancing abrasion resistance and glossiness. A thickness of 200 μm or less improves the productivity in the drying and prevents the abrasion resistance from deteriorating due to poor drying.

Processing Fluid

The processing fluid for use in the processing fluid application contains a water-soluble organic solvent, a surfactant, an additive, water, and other optional components.

It is preferable that the processing fluid for use in the processing fluid application be substantially free of pigment. The fluid is preferably a liquid composition in which a solid content of a substance such as resin is dissolved or dispersed. "Substantially free of pigment" means that the proportion of a pigment in processing fluid is 0.01 percent by mass or less.

The type of processing fluid is selected from water-borne varnish, oil-borne varnish, and UV varnish to suit to a particular application. Water-based varnish is suitable to prevent an image from blurring.

The processing fluid preferably contains a resin emulsion in which resin particles are dispersed in water. There is no specific limitation to the type of resin, which can be suitably selected to suit to a particular application.

Specific examples include, but are not limited to, polyester, epoxy resin, polyurethane, polyamide, polyether, (meth)acrylic resin, acrylic-silicone resin, fluorochemical resin, polyolefin, polystyrene-based resin, polyvinyl ester-based resin, polyacrylic acid-based resin, cellulose, rosin, and natural rubber. These can be used alone or in combination.

Of these, it is preferable to contain acrylic resin and/or urethane resin to enhance the abrasion resistance. The resin emulsion can be synthesized or procured.

Specific examples of procurable resin particles include, but are not limited to, Mowinyl 972, Mowinyl LDM 6740, Mowinyl LDM7522, Mowinyl VDM7410, Mowinyl ES-85, and Mowinyl ES-90 (all manufactured by The Nippon Synthetic Chemical Industry Co., Ltd.), TOCRYL W-4322, TOCRYL W-6107, TOCRYL W-6108, TOCRYL W-6109, TOCRYL W-6139, TOCRYL W-6140, TOCRYL W463, TOCRYL BCX-1160 R-2, TOCRYL BCX-3101, TOCRYL W-172, TOCRYL BCX-8104, and TOCRYL X-4402 (all manufactured by TOYOCHEM CO., LTD.), SUPERFLEX® SF-150, SUPERFLEX® SF-210, and SUPERFLEX® SF-420NS (all manufactured by DKS Co., Ltd.). NeoCryl A1094, NeoCryl A662, NeoRezR-600, NeoPac R9699, and NeoRez R-2170 (all manufactured by Sanyo Chemical Industries, Ltd.), PERMARIN UA00 (manufactured by Sanyo Chemical Industries, Ltd.), Vinyblan 2586 and Vinyblan 2985 (both manufactured by Nissin Chemical co., ltd.), SUMIKAFLEX® 305HQ, SUMIKAFLEX® 355HQ, SUMIKAFLEX® 752, and SUMIKAFLEX® 830 (all manufactured by Sumika Chemtex Company, Limited), VONCOAT 4001, VONCOAT 5400EF, and VONCOAT 5454 (all manufactured by DIC Corporation). TAKELAC™ W-5661, TAKELAC™ W-6061, and TAKELAC™ W-6355 (all manufactured by Mitsui Chemicals, Inc.), and Arrowbase CB-1200 (manufactured by UNITIKA LTD.)

The median diameter (D50) of resin particles is not particularly limited and is suitably selected to suit to a particular application. The diameter is preferably 200 nm or less, more preferably from 1 to 200 nm, and furthermore preferably from 1 to 100 nm to achieve good abrasion resistance and glossiness.

The median diameter (D50) is measured by using a device such as a particle size analyzer (Nanotrac Wave-UT151, manufactured by MicrotracBEL Corp.).

The glass transition temperature Tg of a resin emulsion is 20 degrees C. or higher and lower than the drying temperature in the drying. Resin particles are merged with this heat in the drying, which is advantageous to improve the image robustness. Glossiness is also enhanced.

The content of the resin in processing fluid has no particular limit and is selected to suit to a particular application. The proportion of the resin in the total amount of processing fluid is preferably from 1 to 30 percent by mass and more preferably from 5 to 20 percent by mass to achieve good storage stability.

The water-borne varnish may furthermore optionally contain additives such as a surfactant, defoaming agent, preservative and fungicide, corrosion inhibitor, and pH regulator. The additive is selected from the same additives as those for the ink mentioned above.

Drying

The image is dried with heat in the drying. In the drying, drying with heat is suitable using a heat source. As the heating device for use in the drying, a device capable of evenly heating the printing surface is preferable. Images can be dried by blowing heated wind or warming a drum roller brought into contact with a recording medium. It is also possible to use a device such as a nichrome wire heater, halogen heater, ceramic heater, or carbon heater, but the device is not limited thereto.

Of these, a heated wind drying readily adjusts the level of drying by controlling the amount of wind or temperatures and quickly and evenly dries the printing surface without directly touching a recording medium. Heated wind drying is preferable to enhance the productivity and image quality. Using a heated wind heater is thus particularly preferable.

When heated with a heated wind heater, it is preferable that the temperature of the heated wind be preferably from 50 to 150 degrees C. and the speed of the heated wind be from 5 to 20 m/s at the position of a recording medium. When the temperature is 50 degrees C. or higher, the resin contained in overcoat processing fluid is quickly merged, which enhances abrasion resistance. The glossiness is improved at temperatures of 150 degrees C. or lower because the drying speed becomes moderate. A wind speed of 5 m/s or more enhances the productivity. A wind of 20 m/s or lower improves the glossiness.

Other Embodiments of Printing Device

Figure 2:
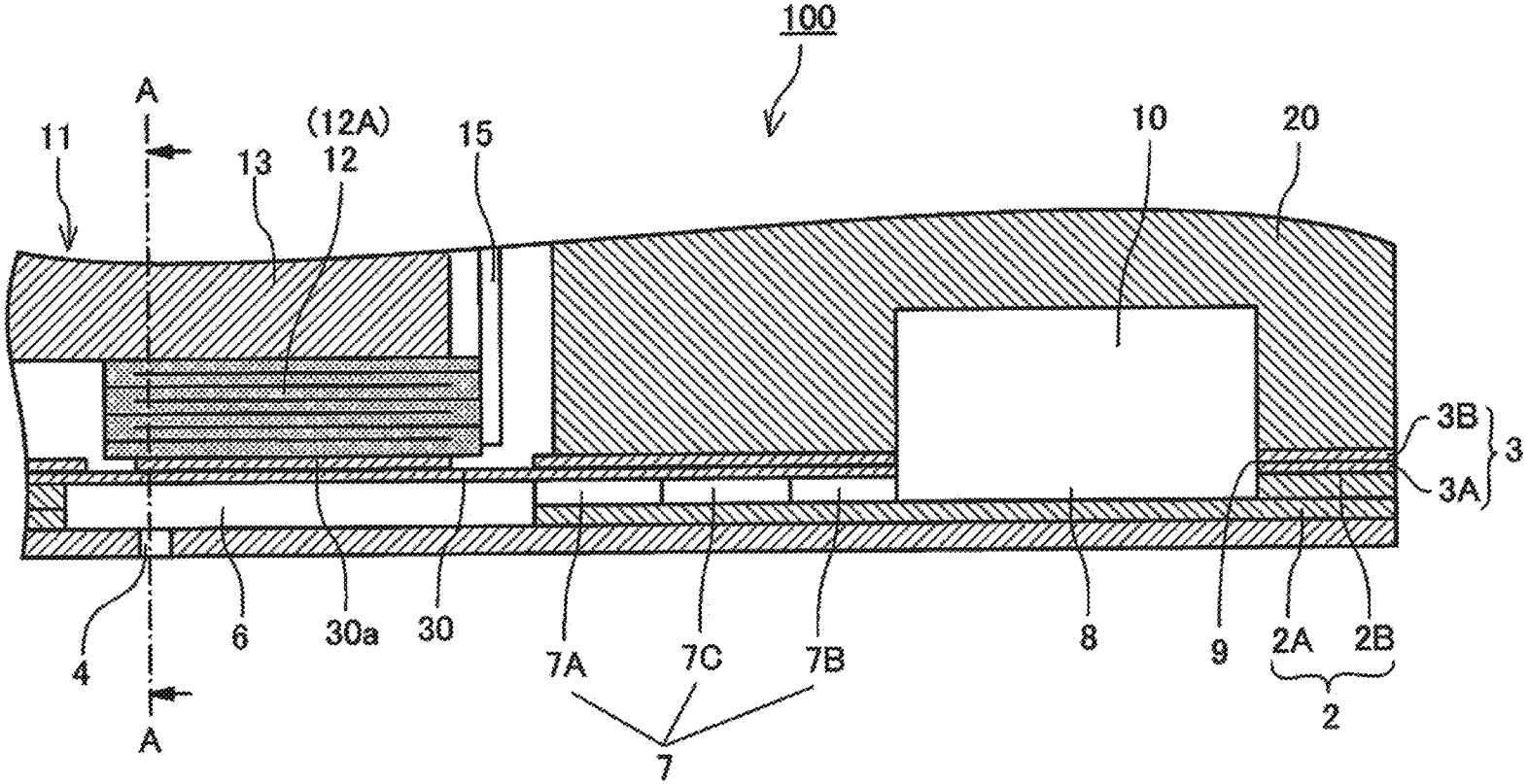
FIG. 2 is a diagram illustrating a cross sectional view of a liquid discharging head along the direction (longitudinal direction of pressure chamber) vertical to the nozzle arrangement direction of the head.
Figure 3:
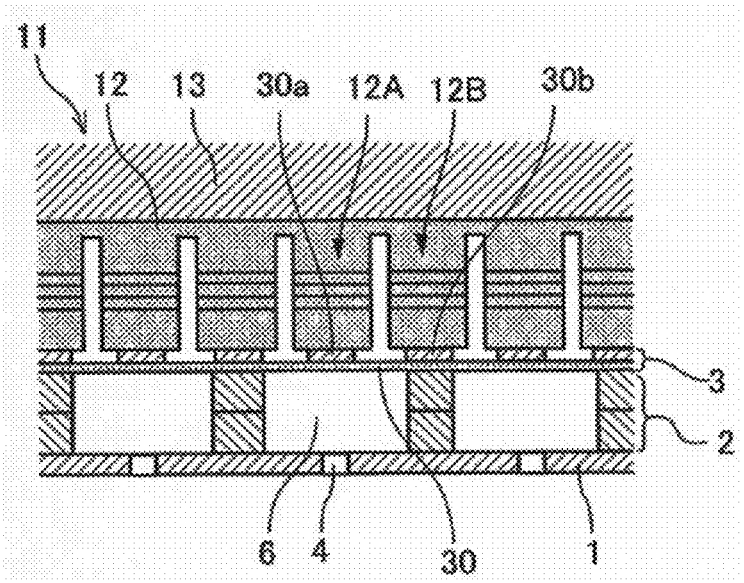
FIG. 3 is a diagram illustrating a cross sectional view of a liquid discharging head along the nozzle arrangement direction of the head.
Figure 4:
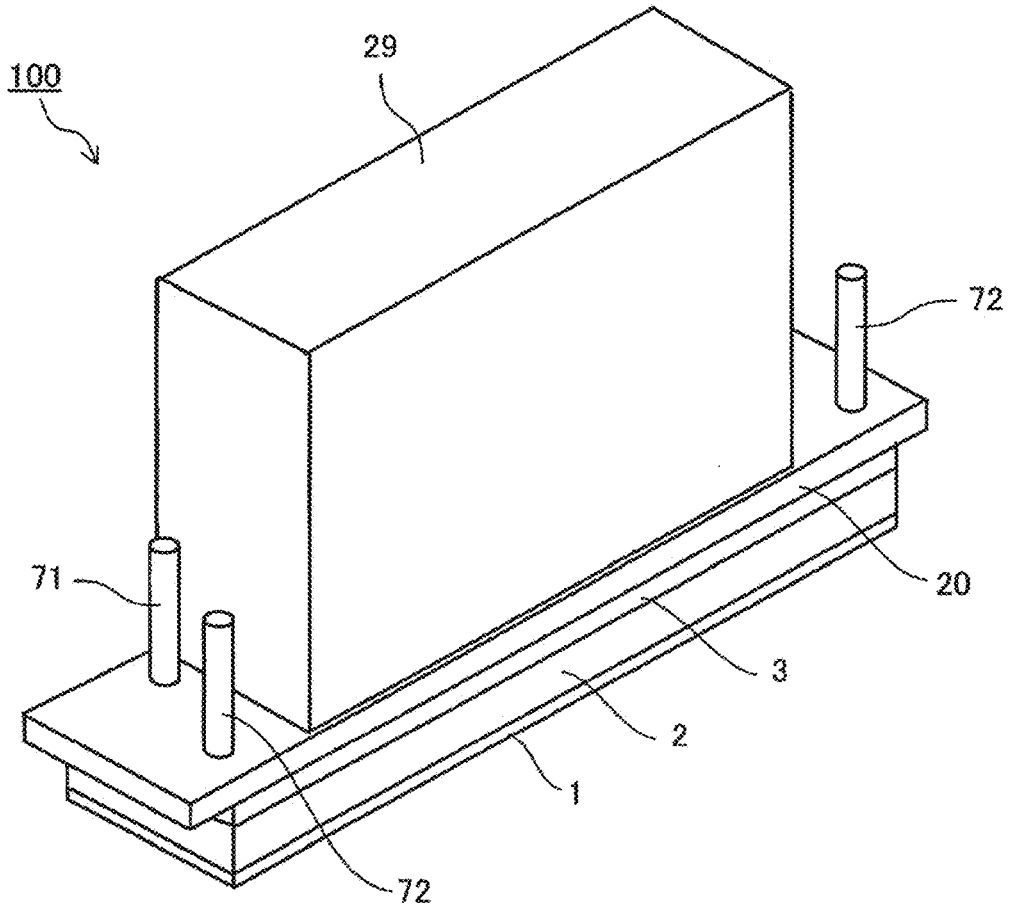
FIG. 4 is a diagram illustrating a perspective view of a liquid discharging head.
Figure 5:
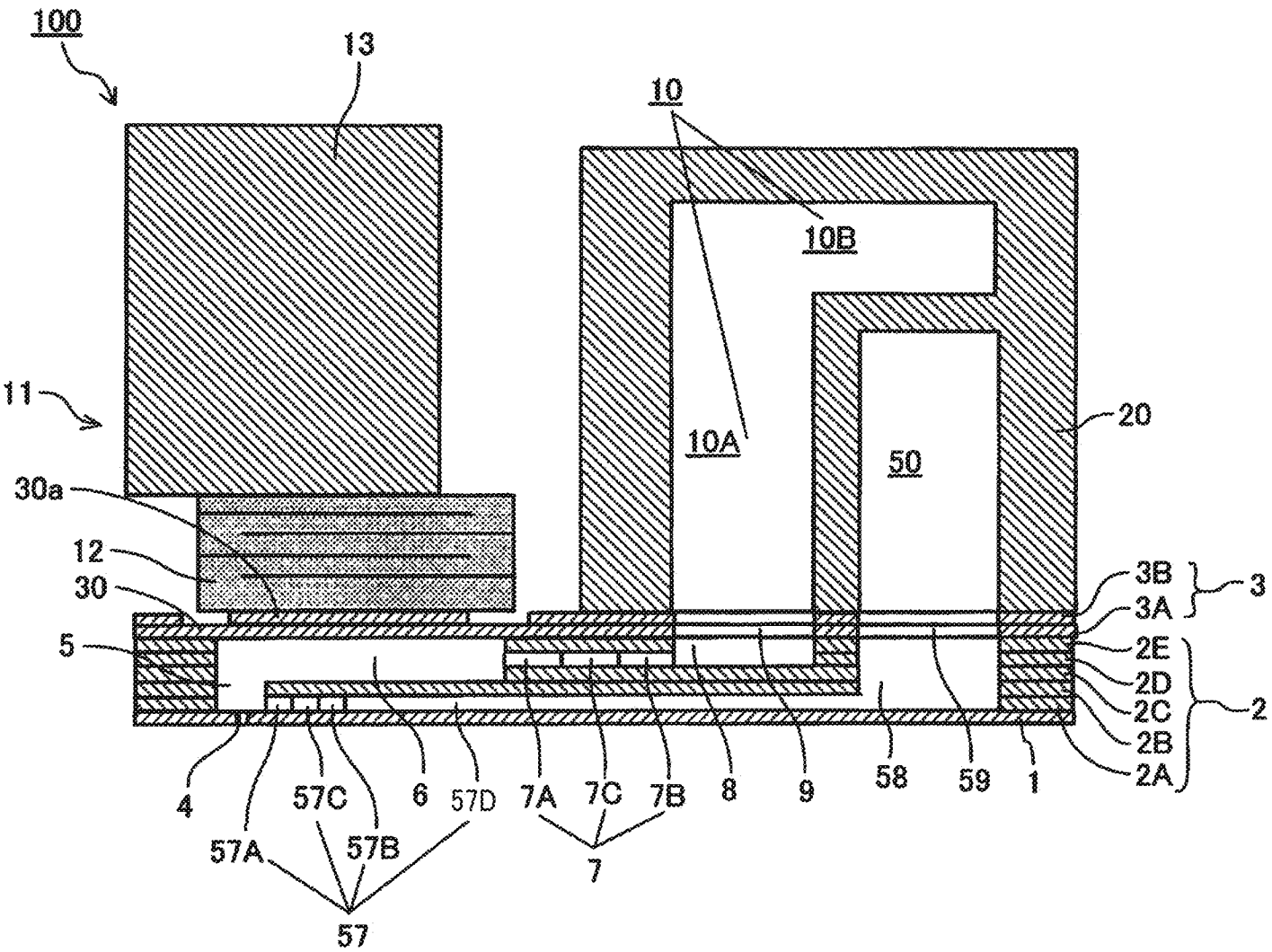
FIG. 5 is a diagram illustrating a cross sectional view of a liquid discharging head along the nozzle arrangement direction of the head.

Other embodiments of the printing device for executing the image relating to the present disclosure are described below. FIG. 2 is a diagram illustrating a cross sectional view of a liquid discharging head along the direction (longitudinal direction of liquid chamber) vertical to the nozzle arrangement direction of the head. FIG. 3 is a diagram illustrating a cross sectional view of the head along the nozzle arrangement direction. FIG. 4 is a diagram illustrating a perspective view of the appearance of a liquid discharging head relating to the embodiment. FIG. 5 is a diagram illustrating a cross sectional view of the head along the direction perpendicular to the nozzle arrangement direction.

In a liquid discharging head 100 in the present embodiment, a nozzle plate 1, a flow path plate 2 as an individual flow path member, and a diaphragm member 3 as a wall surface member are laminated and jointed to each other. The liquid discharging head 100 further includes a piezoelectric actuator 11 that displaces a diaphragm (vibration region) 30 of the diaphragm member 3 and a common flow path member 20 doubling as a frame member of the liquid discharging head 100.

The nozzle plate 1 includes multiple nozzles 4 for discharging liquid.

The flow path plate 2 forms a plurality of pressure chambers 6 communicating with multiple nozzles 4, an individual supply flow path 7 as individual flow path individually communicating with each pressure chamber 6, and an intermediate supply flow path 8 as a liquid introduction part communicating with a single or more individual supply flow paths 7 (single in the present embodiment).

The diaphragm member 3 includes a plurality of the displaceable diaphragms (vibration regions) 30, which form the wall surface of the pressure chamber 6 of the flow path plate 2. The diaphragm member 3 has a dual layer structure, which is not limiting. The diaphragm member 3 is configured of a first layer 3A forming a thin part and a second layer 3B forming a thick part from the side of the flow path plate 2.

The first layer 3A as a thin part forms the displaceable vibration region 30 at the portion corresponding to the pressure chamber 6. In the vibration region 30, a convex portion 30*a* jointed to the piezoelectric actuator 11 at the second layer 3B.

On the opposite side of the pressure chamber 6 of the diaphragm member 3, there is arranged the piezoelectric actuator 11 including an electromechanical converter element as a driving device (e.g., actuator, pressure generator) for transforming the vibration region 30 of the diaphragm member 3.

The piezoelectric actuator 11 includes a required number of pillar-like piezoelectric elements 12 spaced a predetermined gap therebetween in a pectinate manner, which is formed by grooving a piezoelectric member jointed onto a base member 13 by half cut dicing. The piezoelectric element 12 is jointed to the convex portion 30*a* as a thick part formed in the vibration region 30 of the diaphragm member 3.

This piezoelectric element 12 is formed by alternately laminating piezoelectric layers and inner electrodes. Each of the inner electrodes is pulled out to the exterior to provide outer electrodes (end-face electrode), to which flexible wiring members 15 is connected.

The common flow path member 20 forms a common supply flow path 10 communicating with a plurality of pressure chambers 6. The common supply flow path 10 communicates with an intermediate supply flow path 8 as a liquid introducing part via an outlet 9 provided to the diaphragm member 3. The common supply flow path 10 communicates with the individual supply flow path 7 via the intermediate supply flow path 8.

In the liquid discharging head 100, for example, the piezoelectric element 12 shrinks when the voltage applied to the piezoelectric element 12 is lowered from a reference voltage (intermediate voltage). For this reason, the vibration region 30 of the diaphragm member 3 is pulled, thereby inflating the pressure chamber 6, so that the liquid flows into the inside of the pressure chamber 6.

Thereafter, the voltage applied to the piezoelectric element 12 is raised to elongate the piezoelectric element 12 in the lamination direction, thereby transforming the vibration region 30 of the diaphragm member 3 in the direction of the nozzle 4. The pressure chamber 6 thus shrinks so that the liquid in the pressure chamber 6 is pressurized and discharged from the nozzle 4.

The liquid discharging head 100 is a circulative liquid discharging head in which the nozzle plate 1, the flow path plate 2, and the diaphragm member 3 as a wall surface member are laminated and jointed to each other. The liquid discharging head 100 further includes a piezoelectric actuator 11 that displaces a diaphragm (vibration region) 30 of the diaphragm member 3 and a common flow path member 20 doubling as a frame member of the liquid discharging head 100.

As illustrated in FIG. 4, the liquid discharging head 100 in the present embodiment is a circulative liquid discharging head in which the nozzle plate 1, the flow path plate 2, and the diaphragm member 3 as a wall surface member are laminated and jointed to each other. The liquid discharging head 100 further includes the piezoelectric actuator 11 that displaces the vibration region 30 of the diaphragm member 3 and the common flow path member 20 doubling as a frame member of the head and a cover 29.

The flow path plate 2 forms a plurality of pressure chambers 6 communicating with multiple nozzles 4 via corresponding nozzle communicating path 5, the individual supply flow path 7 doubling as a plurality of liquid resistances communicating with corresponding pressure chambers 6, and the intermediate supply flow path 8 as one or more liquid introduction parts communicating with two or more individual supply flow paths 7.

The individual supply flow path 7 includes a first flow path 7A and a second flow path 7B both having a flow resistance higher than that of the pressure chamber 6 and a third flow path 7C which is disposed between the first flow path 7A and the second flow path 7B and has a flow resistance lower than those of the first flow path 7A and the second flow path 7B.

The flow path plate 2 is a laminate of plate members 2A to 2E but is not limited thereto.

As illustrated in FIG. 5, the flow path plate 2 forms a plurality of individual collecting flow path 57 along the surface direction of the flow path plate 2 individually communicating with a plurality of pressure chambers 6 via a nozzle communicating path 5 and an intermediate collecting flow path 58 as one or more liquid drawing parts communicating with two or more individual collecting flow paths 57.

The individual collecting flow path 57 includes a first flow path 57A and a second flow path 57B both having a flow resistance higher than that of the pressure chamber 6 and a third flow path 57C which is disposed between the first flow path 57A and the second flow path 57B and has a flow resistance lower than those of the first flow path 57A and the second flow path 57B. In the individual collecting flow path 57, the flow path 57D disposed downstream of the second flow path 57B in the circulation direction has the same flow path width as that of the third flow path 57C.

The common flow path member 20 forms a common supply flow path 10 and a common collecting flow path 50. In the present embodiment, the common supply flow path 10 includes a flow path 10A along with the common collecting flow path 50 in the nozzle arrangement direction and a flow path 10B not along with the common collecting flow path 50.

The common supply flow path 10 communicates with an intermediate supply flow path 8 as a liquid introducing part via the outlet 9 provided to the diaphragm member 3. The common supply flow path 10 communicates with the individual supply flow path 7 via the intermediate supply flow path 8. The common collecting flow path 50 communicates with the intermediate collecting flow path 58 as a liquid drawing portion via the outlet 59 provided to the diaphragm member 3 and communicates with the individual collecting flow path 57 via the intermediate collecting flow path 58.

The common supply flow path 10 communicates with a supply port 71 and the common collecting flow path 50 communicates with a collection port 72.

The other layer structures of the diaphragm member 3 and the configuration of the piezoelectric actuator 11 are the same as described above.

In this liquid discharging head 100, the piezoelectric element 12 is elongated in the lamination direction in the same manner as described above, thereby transforming the vibration region 30 of the diaphragm member 3 in the direction of the nozzle 4. The pressure chamber 6 thus shrinks so that the liquid in the pressure chamber 6 is pressurized and discharged from the nozzle 4.

The liquid not discharged from the nozzle 4 passes the nozzle 4 and is collected from the individual collecting flow path 57 to the common collecting flow path 50. The liquid is supplied again from the common collecting flow path 50 to the common supply flow path 10 via an external circulation route. When the nozzle 4 is not discharging liquid, the liquid is circulated from the common supply flow path 10 to the common collecting flow path 50 via the pressure chamber 6 and supplied to the common supply flow path 10 via the external circulation route.

In the present embodiment, transmission of the pressure fluctuation caused by liquid discharging to the common supply flow path 10 and the common collecting flow path 50 can be minimized by decaying the pressure fluctuation with a simple configuration.

Figure 6:
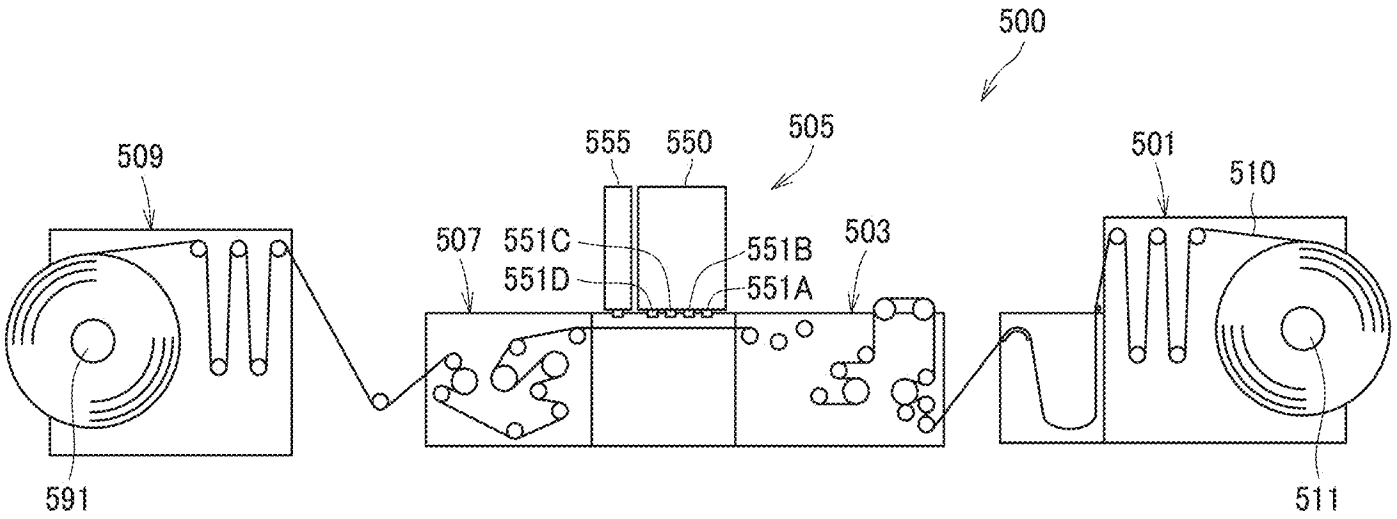
FIG. 6 is a schematic diagram illustrating a device for discharging liquid.
Figure 7:
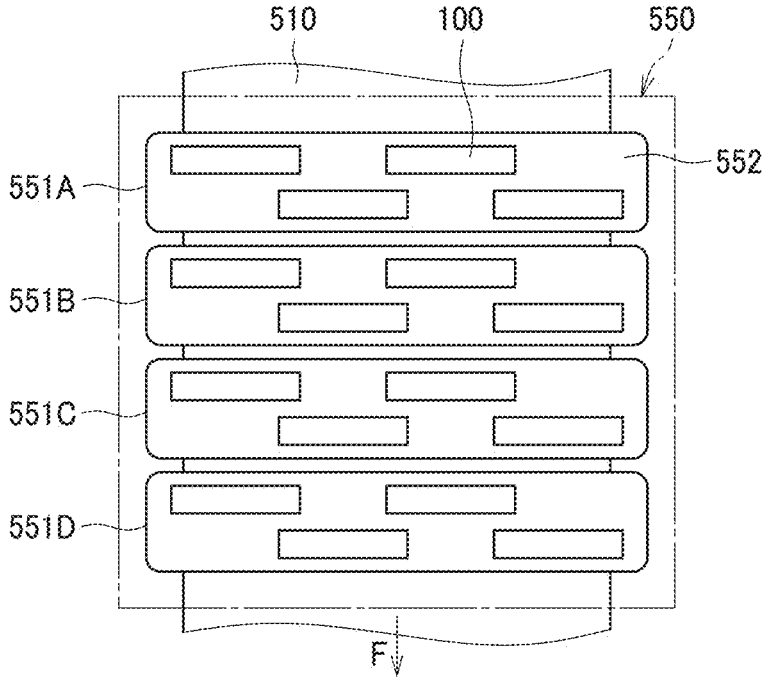
FIG. 7 is a diagram illustrating a planar view of an example of the head unit of a device for discharging liquid.

Next, an embodiment of the printing device is described with reference to FIGS. 6 and 7. FIG. 6 is a diagram illustrating a schematic view of the device. FIG. 7 is a diagram illustrating a planar view of the head unit of the device.

A printing device 500 for discharging liquid includes a feed-in device 501 for feeding a continuous body 510, a guiding device 503 for guiding the continuous body such as continuous paper and sheet material fed from the feed-in device 501 to a printing unit 505 for discharging the liquid onto the continuous body 510 to create images thereon, a drying device 507 for drying the continuous body 510, and a feed-out device 509 for conveying the continuous body 510.

The continuous body 510 is sent out from a reeling-down roller 511 of the feed-in device 501, guided and conveyed by each roller of the feed-in device 501, the guiding device 503, the drying device 507, and the feed-out device 509, and reeled up by a reeling up roller 591 of the feed-out device 509

This continuous body 510 is conveyed on a conveyance guiding member 559 in the printing unit 505, facing a head unit 550 and a head unit 555. Images are formed on the continuous body 510 with liquid discharged from the head unit 550 followed by post-processing with processing fluid discharged from the head unit 555.

An active energy radiation unit is disposed between the head unit 550 and the head unit 555.

The head unit 550 includes, for example, four color full line type head arrays 551A, 551B, 551C, and 551D (also referred to as head array 551, if color is not distinguished) disposed in this order upstream in the conveyance direction.

Each head array 551 is a liquid discharging device that discharges black K, cyan C, magenta M, and yellow Y to the continuous body 510 in the middle of conveyance. The type and the number of colors are not limited thereto.

In the head array 551, the liquid discharging heads (hereinafter simply referred to as head) 100 are disposed on a base member 552 in a zigzag manner. The configuration is not limited thereto.

Figure 8:
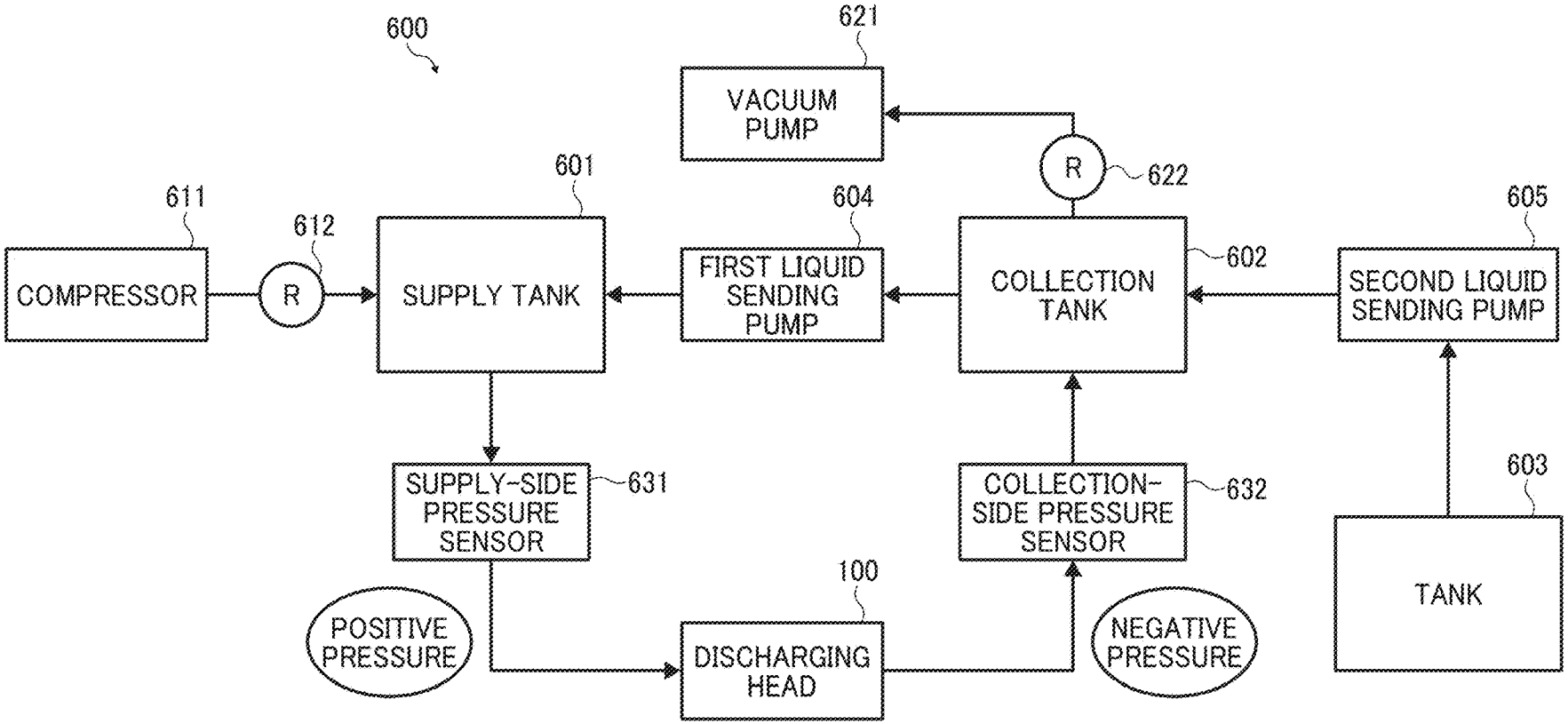
FIG. 8 is a block diagram illustrating a liquid circulation device.

The liquid circulating device is described using an example with reference to FIG. 8. FIG. 8 is a block diagram illustrating the liquid circulating device. In this block diagram, there is only one head. When multiple heads are arranged, liquid supply routes and liquid collecting routes are respectively connected to the heads on the supply side and the collecting side via manifold.

A liquid circulating device 600 includes a supply tank 601, a collection tank 602, a tank 603, a first liquid sending pump 604, a second liquid sending pump 605, a compressor 611, a regulator 612, a vacuum pump 621, a regulator 622, a supply side pressure sensor 631, and a collection-side pressure sensor 632.

The compressor 611 and the vacuum pump 621 constitute a device that causes the difference in the inside pressure between the supply tank 601 and the collection tank 602.

The supply-side pressure sensor 631 is disposed between the supply tank 601 and the head 100 and connected to the liquid route on the supply side connected to a supply port 71 of the head 100. The collection side pressure sensor 632 is disposed between the head 1 and the collection tank 602 and connected to the liquid route on the collection side connected to a collection port 72 of the head 100.

One end of the collection tank 602 is connected to the supply tank 601 via the first liquid sending pump 604 and, the other end, with the tank 603 via the second liquid sending pump 605.

Due to this configuration, the liquid flows from the supply tank 601 into the head 100 through the supply port 71 and is collected at the collection tank 602 through the collection port 72. Furthermore, the liquid is sent from the collection tank 602 to the supply tank 601 by the first liquid sending pump 604 to form the circulation route through which the liquid circulates.

The compressor 611 is connected to the supply tank 601, which is controlled in order that the supply-side pressure sensor 631 can detect a predetermined positive pressure. The vacuum pump 621 is connected to the collection tank 602, which is controlled in order that the collection-side pressure sensor 632 can detect a predetermined negative pressure.

This detection system maintains the negative pressure of meniscus constant while circulating the liquid through the head 100.

When the nozzle 4 of the head 100 discharges liquid, the liquid contained in the supply tank 601 and the collection tank 602 decreases. To avoid this decrease, the liquid is replenished from the tank 603 to the collection tank 602 using the second liquid sending pump 605.

When to replenish the liquid from the tank 603 to the collection tank 602 is controlled based on the detection result of a device such as a liquid surface sensor disposed in the collection tank 602. For example, when the height of the liquid in the collection tank 602 falls below a predetermined value, the liquid is replenished.

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, embodiments of the present disclosure are described in detail with reference to Examples but are not limited thereto.

Preparation Example of Pigment Dispersion

Liquid Dispersion of Cyan Pigment

After replacement with nitrogen gas in a 1 L flask equipped with a mechanical stirrer, a thermometer, a nitrogen gas introducing tube, a reflux tube, and a dripping funnel, 11.2 parts of styrene, 2.8 parts of acrylic acid, 12.0 parts of lauryl methacrylate, 4.0 parts of polyethylene glycol methacrylate, 4.0 parts of styrene macromer, and 0.4 parts of mercapto ethanol were mixed and heated to 65 degrees C. in the flask.

Next, a liquid mixture of 100.8 parts of styrene, 25.2 parts of acrylic acid, 108.0 parts of lauryl methacrylate, 36.0 parts of polyethylene glycol methacrylate, 60.0 parts of hydroxyethyl methacrylate, 36.0 parts of styrene macromer, 3.6 parts of mercapto ethanol, 2.4 parts of azobismethyl valeronitrile, and 18 parts of methylethyl ketone was added dropwise to the flask in two and a half hours. Subsequently, a liquid mixture of 0.8 parts of azobismethyl valeronitrile and 18 parts of methylethyl ketone was added dropwise to the flask in half an hour. Subsequent to one-hour aging at 65 degrees C., 0.8 parts of azobisdimethyl valeronitrile was added followed by another one-hour aging. After the reaction was complete, 364 parts of methylethyl ketone was added to the flask to obtain 800 parts of polymer solution A having a concentration of 50 percent by mass.

Thereafter, 28 parts of the thus-obtained polymer solution A, 26 parts of phthalocyanine pigment (CHROMOFINE Blue-A-220JC, manufactured by Dainichiseika Color & Chemicals Mfg. Co., Ltd.), 13.6 parts of 1 mol/L aqueous solution of potassium hydroxide, 20 parts of methylethyl ketone, and 13.6 parts of deionized water were sufficiently stirred, followed by kneading with a roll mill to obtain a paste. The thus-obtained paste was charged in 200 parts of deionized water. Subsequent to through stirring, methylethyl ketone and water were distilled away using an evaporator. This liquid dispersion was filtered with a polyvinylidene fluoride membrane filter having an average pore diameter of 5.0 μm under pressure to remove coarse particles. A cyan pigment liquid dispersion as liquid dispersion of fine polymer particle containing pigment was thus obtained which had a pigment concentration of 15 percent by mass and a solid content of 20 percent by mass. The median particle diameter ($D_{50}$) of the polymer particles in the liquid dispersion of pigment was measured.

The median size ($D_{50}$) was 56.0 nm as measured by a particle size distribution measuring instrument (NANOTRAC UPA-EX 150, manufactured by NIKKISO CO., LTD.).

Preparation Example 1 of Inkjet Ink

Ink 1

A mixture of 2.0 parts of propane-1,2-diol, 1.7 parts of 3-methoxy-3-methyl-1-butanol, 5.0 parts of 3-methoxy-N, N-dimethyl propionamide, 1.2 parts of TEGO Wet270 (manufactured by EVONIK INDUSTRIES), 0.1 parts of Proxel LV (manufactured by Avecia Inkjet Limited), 0.1 parts of 1,2,3-benzotriazole, and 68.8 parts of deionized water were stirred for one hour to obtain an equalized liquid mixture. A total of 6.0 parts of 4-hydroxybutyl acrylate was added to the liquid mixture followed by one-hour stirring. Thereafter, 3.4 parts (solid content) of the cyan pigment liquid dispersion 1.0 part of 2-hydroxy-2-methyl-1-phenyl propanone, and 8.0 parts (solid content) of reactive urethane dispersion (Laromer LR 8983, manufactured by BASF SE) were added followed by stirring for one hour. This liquid dispersion was filtered with a polyvinylidene fluoride membrane filter having an average pore diameter of 5.0 μm under pressure to remove coarse particles and dust, thereby preparing ink 1.

Preparation Example 2 of Inkjet Ink

Ink 2

Ink 2 was prepared in the same manner as in Ink 1 except that 4-hydroxybutyl acrylate was not added and the deionized was changed to 74.8 parts by mass.

Manufacturing Example 1

Overcoat Processing Fluid 1

The water-soluble organic solvent, surfactant, additives, and water shown in Table 1 were stirred for one hour to obtain an equalized liquid mixture. Resin emulsion (TOCYL W-6107, manufactured by TOYOCHEM CO., LTD.) was added to the obtained liquid mixture followed by stirring for one hour. Next, this liquid dispersion was filtered with a polyvinilydene fluoride membrane filter having an average pore diameter of 5.0 μm under pressure to remove coarse particles and dust, thereby preparing overcoat processing fluid 1. The values in Table 1 are represented in percent by mass as the mixing ratio.

Manufacturing Example 2

Overcoat Processing Fluid 2

Overcoat processing fluid 2 was prepared in the same manner as in Manufacturing Example 1 except that the resin was changed to the resin emulsion (VONCOAT 5400EF, manufactured by DIC Corporation) shown in Table 1.

Manufacturing Example 3

Overcoat Processing Fluid 3

Overcoat processing fluid 3 was prepared in the same manner as in Manufacturing Example 1 except that the resin was changed to the resin emulsion (Mowinyl ES-90, manufactured by The Nippon Synthetic Chemical Industry Co., Ltd.) shown in Table 1.

Manufacturing Example 4

Overcoat Processing Fluid 4

Overcoat processing fluid 4 was prepared in the same manner as in Manufacturing Example 1 except that the resin was changed to the resin emulsion (Vinyblan 2985, manufactured by Nissin Chemical co., ltd.) shown in Table 1.

Manufacturing Examples 5 to 9

Overcoat Processing Fluids 5 to 9

Overcoat processing fluids 5 to 9 were prepared in the same manner as in Manufacturing Example 1 except that the materials and mixing ratio were changed as shown in Table 1.

TABLE 1

| Material | | Processing fluid 1 | Processing fluid 2 | Processing fluid 3 | Processing fluid 4 | Processing fluid 5 |
|---|---|---|---|---|---|---|
| Propylene glycol | | 8.4 | 8.4 | 8.4 | 8.4 | 8.4 |
| 3-methoxy-3-methyl-1-butanol | | 5.0 | 5.0 | 5.0 | 5.0 | |
| 3-methoxy-N,N-dimethyl propionamides | | | | | | 5.0 |
| TEGO Wet270 | | 1.0 | 1.0 | 1.0 | 1.0 | 0.5 |
| PROXEL LV | | 0.05 | 0.05 | 0.05 | 0.05 | 0.05 |
| Benzotriazole | | 0.05 | 0.05 | 0.05 | 0.05 | 0.05 |
| Resin (solid content) | TOCRYL W-6107 | 10.0 | | | | 10.0 |
| | VONCOAT 5400EF | | 10.0 | | | |
| | Mowinyl ES-90 | | | 10.0 | | |
| | Vinyblan 2985 | | | | 10.0 | |
| Deionized water: Balance | | 75.5 | 75.5 | 75.5 | 75.5 | 76.0 |
| Median particle diameter (D50) (nm) of resin particle | | 75 | 165 | 110 | 250 | 75 |
| Glass transition temperature Tg (degrees C.) of resin emulsion | | 43 | 6 | 97 | 25 | 43 |

| Material | | Processing fluid 6 | Processing fluid 7 | Processing fluid 8 | Processing fluid 9 |
|---|---|---|---|---|---|
| Propylene glycol | | 8.4 | 8.4 | 8.4 | 8.4 |
| 3-methoxy-3-methyl-1-butanol | | | 30.0 | 1.0 | |
| 3-methoxy-N,N-dimethyl propionamides | | 10.0 | | | |
| TEGO Wet270 | | | 2.0 | 1.0 | |
| PROXEL LV | | 0.05 | 0.05 | 0.05 | 0.05 |
| Benzotriazole | | 0.05 | 0.05 | 0.05 | 0.05 |
| Resin (solid content) | TOCRYL W-6107 | 10.0 | 10.0 | 10.0 | 10.0 |
| | VONCOAT 5400EF | | | | |
| | Mowinyl ES-90 | | | | |
| | Vinyblan 2985 | | | | |
| Deionized water: Balance | | 71.5 | 49.5 | 79.5 | 81.5 |
| Median particle diameter (D50) (nm) of resin particle | | 75 | 75 | 75 | 75 |
| Glass transition temperature Tg (degrees C.) of resin emulsion | | 43 | 43 | 43 | 43 |

Example 1

A printing device illustrated in FIG. 1 employing a single pass method was prepared to execute ink printing (discharging), active energy radiation irradiation, processing fluid application, and drying in a single conveyance of a recording medium in line. The device carried piezoelectric on-demand heads. Ink 1 was used as inkjet ink.

The printing conditions are:
head gap of 2 mm;
amount of ink discharged per droplet of 4 pL;
1,200 dpi×1,200 dpi; and
amount of ink attached of 1.0 μl/cm$^2$.

Subsequent to printing with ink, the ink was cured upon application of ultraviolet irradiator (Subzero 085, D valve, manufactured by Integration Technology) carried in the printing device. The ultraviolet irradiator emitted ultraviolet radiation with two lamps at a illuminance of 3.7 W/cm$^2$ and an integral of light of UV-A of 352 mJ/cm$^2$. The time interval between the printing with ink and irradiation of UV radiation, meaning, the time taken from the discharging of the ink in the ink discharging to the irradiation of active energy radiation in the active energy radiation was adjusted to five seconds by changing the conveyance speed of a recording medium between the piezoelectric on-demand head and the UV irradiator.

After the image was exposed to UV radiation, a roller coater was used for the image to apply the overcoat processing fluid 1 of Manufacturing Example 1 to the image with a thickness of application of 50 μm. Thereafter, the image was dried by a heated wind heater carried in the printing device at a temperature of the heated wind of 70 degrees C. and a wind speed of 10 m/s, so that printed matter of Example 1 was obtained.

Example 1 was conducted in a condition of 22.5 to 23.5 degrees C. and 45 to 55 percent RH. The recording medium used was OK cardboard (manufactured by OJI PAPER CO., LTD.) as A4 coated cardboard.

Example 2

Printed matter of Example 2 was obtained in the same manner as in Example 1 except that the time interval between printing and UV irradiation was changed to 0.5 seconds.

The time interval was adjusted by changing the conveyance speed of the recording medium between the piezoelectric on-demand head and the UV irradiator.

Example 3

Printed matter of Example 3 was obtained in the same manner as in Example 1 except that the time interval between printing and UV irradiation was changed to 10 seconds. The time interval was adjusted by changing the conveyance speed of the recording medium between the piezoelectric on-demand head and the UV irradiator.

Example 4

Printed matter of Example 3 was obtained in the same manner as in Example 1 except that the time interval between printing and UV irradiation was changed to 15 seconds. The time interval was adjusted by changing the conveyance speed of the recording medium between the piezoelectric on-demand head and the UV irradiator.

Examples 5 to 12

Printed matters of Examples 5 to 12 were obtained in the same manner as in Example 1 except that overcoat processing fluid 1 was changed to the overcoat processing fluids 2 to 9 shown in Table 2.

Examples 13 and 14

Printed matter of Examples 13 and 14 were obtained in the same manner as in Example 1 except that the integral of light of UV-A was changed to 10 mJ/cm$^2$ and 2,100 mJ/cm$^2$, respectively. The integral of light of UV-A was adjusted by changing the output of the lamp of the UV irradiator and the conveyance speed of a recording medium passing under the UV irradiator.

Examples 15 and 16

Printed matters of Examples 15 and 16 were obtained in the same manner as in Example 1 except that the temperatures of the heated wind of the heated wind heater were changed to 45 degrees C. and 155 degrees C., respectively.

Examples 17 and 18

Printed matters of Examples 17 and 18 were obtained in the same manner as in Example 1 except that the speed of the heated wind of the heated wind heater were changed to 4 m/s and 22 m/s, respectively.

Comparative Examples 1 to 3

Printed matters of Comparative Examples 1 to 3 were obtained in the same manner as in Example 1 except that the order of ink printing, active energy radiation irradiation, processing fluid application, and drying was changed as shown in Table 3.

It is to be noted that since the processes in Examples 1 to 3 were different from that of Examples, the time interval between the ink discharging (printing) and UV irradiation was changed to the time interval between the process 1 and the process 2. In Comparative Examples 1 and 2, the time interval was between the ink printing and the application of the processing fluid. In Comparative Example 3, the time interval was between the ink printing and the drying.

Comparative Example 4

Printed matter of Comparative Example 4 was obtained in the same manner as in Example 1 except that the ink 1 was replaced with the ink 2.

Comparative Example 5

Printed matter of Comparative Example 5 was obtained in the same manner as in Example 1 except that the image was formed without irradiation of active energy radiation.

Comparative Example 6

Printed matter of Comparative Example 6 was obtained in the same manner as in Example 1 except that the image was formed without an application of the processing fluid.

Comparative Example 7

Printed matter of Comparative Example 7 was obtained by using a printing device using serial heads (multi-pass)

under the condition that the time interval between ink printing and UV irradiation was 0.1 seconds. The details are described below.

Ink 1 was used as inkjet ink. An inkjet printer (IPSiO Gxe5500, manufactured by Ricoh Co., Ltd.) employing a multi-pass method was used for printing in a uni-direction with an amount of attached of 1.0 μl/cm$^2$. The printer carried UV irradiator (Subzero 085, D valve, manufactured by Integration Technology) and was capable of emitting UV radiation per reciprocation of the carriage with an illuminance of 3.7 W/cm$^2$ and an integral of light of UV-A of 352 mJ/cm$^2$.

After the image was exposed to UV radiation, a roller coater was used for the image to apply the overcoat processing fluid 1 of Manufacturing Example 1 to the image with a thickness of application of 50 μm. Thereafter, the image was dried by a heated wind heater at a temperature of the heated wind of 70 degrees C. and a wind speed of 10 m/s, so that printed matter of Comparative Example 7 was obtained.

Comparative Example 7 was conducted in a condition of 22.5 to 23.5 degrees C. and 45 to 55 percent RH. The recording medium used was OK cardboard (manufactured by OJI PAPER CO., LTD.) as coated cardboard.

The method was changed to the multi-pass, which changed the total time, which is described later, of 83 seconds.

Comparative Example 8

Printed matter of Comparative Example 8 was obtained in the same manner as in Example 1 except that the time interval between printing and UV irradiation was changed to 0.1 seconds. The time interval was adjusted by changing the conveyance speed of the recording medium and the distance between the piezoelectric on-demand head and the UV irradiator.

Comparative Example 9

Printed matter of Comparative Example 9 was obtained in the same manner as in Example 1 except that the time interval between printing and UV irradiation was changed to 20 seconds. The time interval was adjusted by changing the conveyance speed of the recording medium and the distance between the piezoelectric on-demand head and the UV irradiator.

The ink types, overcoat processing fluid types, and printing conditions of Examples 1 to 18 and Comparative Examples 1 to 9 are shown in Tables 2 and 3.

Measuring and Evaluation

Swelling ratio, contact angle, productivity, abrasion resistance, blurring, and glossiness of the inkjet ink and processing fluid were measured and evaluated. The results are shown in Tables 2 to 4.

Swelling Ratio

A total of 5.0 g of the prepared ink was placed in Teflon™ Petri dish having a diameter of 50 mm and cured upon an application of ultraviolet radiation with an integral of light of UV-A of 17 mJ/cm$^2$ by an ultraviolet irradiator (Subzero 085, D valve, manufactured by Integration Technology). The cured ink was dried in an oven at 100 degrees C. for 12 hours to form a dried ink film.

Then, 0.5 g of the dried ink film was weighed and dipped in 5.0 g of processing fluid, which was allowed to rest at 100 degrees C. for 12 hours. Thereafter, the dried ink film was taken out from the liquid mixture and the processing fluid was wiped off from the film. The mass of the film was measured immediately. The masses of the dried ink film before and after it was dipped in the processing fluid were assigned into the following relationship to calculate the swelling ratio. The values of the swelling ratio shown in Tables 2 and 3 are represented in percent. The processing fluid used was the same as that used in the processing fluid application of each Example and Comparative Example.

Swelling ratio=(mass before dipping−mass after dipping)/(mass before dipping)×100

Contact Angle

A total of 5.0 g of the prepared ink was placed in Teflon™ Petri dish having a diameter of 50 mm and cured upon an application of ultraviolet radiation with an integral of light of UV-A of 17 mJ/cm$^2$ by an ultraviolet irradiator (Subzero 085, D valve, manufactured by Integration Technology). The cured ink was dried in an oven at 100 degrees C. for 12 hours to form a dried ink film.

Next, 2 μl of prepared processing fluid was added dropwise to the prepared dried ink film and the image was taken by a charge coupled diode (CCD) camera. The obtained image of the droplet was subjected to automatic curve fitting to measure the contact angle. The contact angle was measured immediately after the addition dropwise. The contact angles five seconds after the addition were compared.

The processing fluid used was the same as that used in the processing fluid application of each Example and Comparative Example.

Evaluation on Productivity

The time taken for outputting an A4 solid image using the single pass printing device and the multi-pass printing device was measured. The time interval from when the ink was discharged in the ink discharging and the drying was complete to when the solid image was output was determined as the total time shown in Tables 2 and 3. The measuring results of abrasion resistance were evaluated according to the following evaluation criteria. Grade A is the best and B or above is allowable.

Evaluation Criteria

A: total time was 15 seconds or less

B: total time was from more than 15 seconds to 25 seconds

C: total time was from more than 25 seconds to 35 seconds

D: total time was 35 seconds or more

Evaluation on Robustness (Abrasion Resistance)

A 5 cm×20 cm solid image was created using the single pass printing device. Thereafter, the thus-prepared cured matter (solid image) and a standard adjacent fabrics (Kanakin No. 3) for staining for color fastness test, according to JIS L 0803 format) were mounted onto a rubbing fastness tester RT-300, a device according to rubbing tester II type (Gakushin type manufactured by DATEI KAGAKU SEIKI MFG. co., ltd.) specified in Testing Method for Color Fastness to Rubbing (JIS L-0849 format). A weight of 500 g was further mounted. The cured matter was rubbed back and forth 100 times against the fabrics and the weight. The density of the fabrics after the test was measured by eXact Scan (manufactured by X-Rite Inc.). The difference in density between the fabrics used in the test and untested original fabrics was calculated. The abrasion resistance was evaluated based on the calculation results according to the following evaluation criteria. Grade A is the best and C or above is allowable.

Evaluation Criteria

A: Density difference was 0.02 or less

B: Density difference was more than 0.02 to 0.1

C: Density difference was more than 0.1 to 0.2

D: Density difference was more than 0.2

Evaluation on Blur

An image of multiple 5 cm×5 cm solid images placed alongside was created using the single pass printing device. The blurring on the image was visually evaluated according to the following evaluation criteria. Grade A is the best and C or above is allowable.

Evaluation Criteria

A: No blurring was present at color boundary

B: Slight blurring was present at color boundary

C: Blurring was present overall at color boundary

D: Significant blurring was present and visually apparent at color boundary

Evaluation on Glossiness

A 5 cm×20 cm solid image was created using the single pass printing device. The glossiness of the image was visually evaluated according to the following evaluation criteria. Grade C or above is allowable.

Evaluation Criteria

A: Very high glossiness

B: High glossiness (gloss slightly higher than that at base of recording medium

C: Slight glossiness (gloss on the same level of that at base of recording medium D: No glossiness (gloss lower than that at background of recording medium)

TABLE 2

| | Ink | Processing fluid | Order of processes | | | | Time (s) interval between printing and irradiation |
|---|---|---|---|---|---|---|---|
| | | | Process 1 | Process 2 | Process 3 | Process 4 | |
| Example 1 | Ink 1 | Processing fluid 1 | Discharging | Irradiation | Processing fluid | Drying with heat | 5 |
| Example 2 | Ink 1 | Processing fluid 1 | Discharging | Irradiation | Processing fluid | Drying with heat | 0.5 |
| Example 3 | Ink 1 | Processing fluid 1 | Discharging | Irradiation | Processing fluid | Drying with heat | 10 |
| Example 4 | Ink 1 | Processing fluid 1 | Discharging | Irradiation | Processing fluid | Drying with heat | 15 |
| Example 5 | Ink 1 | Processing fluid 2 | Discharging | Irradiation | Processing fluid | Drying with heat | 5 |
| Example 6 | Ink 1 | Processing fluid 3 | Discharging | Irradiation | Processing fluid | Drying with heat | 5 |
| Example 7 | Ink 1 | Processing fluid 4 | Discharging | Irradiation | Processing fluid | Drying with heat | 5 |
| Example 8 | Ink 1 | Processing fluid 5 | Discharging | Irradiation | Processing fluid | Drying with heat | 5 |
| Example 9 | Ink 1 | Processing fluid 6 | Discharging | Irradiation | Processing fluid | Drying with heat | 5 |
| Example 10 | Ink 1 | Processing fluid 7 | Discharging | Irradiation | Processing fluid | Drying with heat | 5 |
| Example 11 | Ink 1 | Processing fluid 8 | Discharging | Irradiation | Processing fluid | Drying with heat | 5 |
| Example 12 | Ink 1 | Processing fluid 9 | Discharging | Irradiation | Processing fluid | Drying with heat | 5 |
| Example 13 | Ink 1 | Processing fluid 1 | Discharging | Irradiation | Processing fluid | Drying with heat | 5 |
| Example 14 | Ink 1 | Processing fluid 1 | Discharging | Irradiation | Processing fluid | Drying with heat | 5 |
| Example 15 | Ink 1 | Processing fluid 1 | Discharging | Irradiation | Processing fluid | Drying with heat | 5 |
| Example 16 | Ink 1 | Processing fluid 1 | Discharging | Irradiation | Processing fluid | Drying with heat | 5 |
| Example 17 | Ink 1 | Processing fluid 1 | Discharging | Irradiation | Processing fluid | Drying with heat | 5 |
| Example 18 | Ink 1 | Processing fluid 1 | Discharging | Irradiation | Processing fluid | Drying with heat | 5 |

| | Ink | Processing fluid | Intensity of lamp ($W/cm^2$) | Integral of light ($mJ/cm^2$) | Drying temperature (degrees C.) | Wind speed (m/s) during drying | Total time (s) | Swelling ratio (percent) | Contact angle (degrees) |
|---|---|---|---|---|---|---|---|---|---|
| Example 1 | Ink 1 | Processing fluid 1 | 3.7 | 352 | 70 | 10 | 12 | — | 14 |
| Example 2 | Ink 1 | Processing fluid 1 | 3.7 | 352 | 70 | 10 | 7 | 1 | 14 |
| Example 3 | Ink 1 | Processing fluid 1 | 3.7 | 352 | 70 | 10 | 17 | 1 | 14 |
| Example 4 | Ink 1 | Processing fluid 1 | 3.7 | 352 | 70 | 10 | 22 | 1 | 14 |
| Example 5 | Ink 1 | Processing fluid 2 | 3.7 | 352 | 70 | 10 | 12 | 1 | 16 |

TABLE 2-continued

| | | | | | | | | | |
|---|---|---|---|---|---|---|---|---|---|
| Example 6 | Ink 1 | Processing fluid 3 | 3.7 | 352 | 70 | 10 | 12 | 1 | 16 |
| Example 7 | Ink 1 | Processing fluid 4 | 3.7 | 352 | 70 | 10 | 12 | 1 | 14 |
| Example 8 | Ink 1 | Processing fluid 5 | 3.7 | 352 | 70 | 10 | 12 | 22 | 18 |
| Example 9 | Ink 1 | Processing fluid 6 | 3.7 | 352 | 70 | 10 | 12 | 34 | 12 |
| Example 10 | Ink 1 | Processing fluid 7 | 3.7 | 352 | 70 | 10 | 12 | 1 | 4 |
| Example 11 | Ink 1 | Processing fluid 8 | 3.7 | 352 | 70 | 10 | 12 | 1 | 26 |
| Example 12 | Ink 1 | Processing fluid 9 | 3.7 | 352 | 70 | 10 | 12 | 1 | 31 |
| Example 13 | Ink 1 | Processing fluid 1 | 0.6 | 10 | 70 | 10 | 11 | 1 | 14 |
| Example 14 | Ink 1 | Processing fluid 1 | 4.0 | 2100 | 70 | 10 | 16 | 1 | 14 |
| Example 15 | Ink 1 | Processing fluid 1 | 3.7 | 352 | 45 | 10 | 12 | 1 | 14 |
| Example 16 | Ink 1 | Processing fluid 1 | 3.7 | 352 | 155 | 10 | 12 | 1 | 14 |
| Example 17 | Ink 1 | Processing fluid 1 | 3.7 | 352 | 70 | 4 | 12 | 1 | 14 |
| Example 18 | Ink 1 | Processing fluid 1 | 3.7 | 352 | 70 | 22 | 12 | 1 | 14 |

TABLE 3

| | Ink | Processing fluid | Order of processes: Process 1 | Process 2 | Process 3 | Process 4 | Time (s) interval between printing and irradiation |
|---|---|---|---|---|---|---|---|
| Comparative Example 1 | Ink 1 | Processing fluid 1 | Discharging | Processing fluid | Irradiation | Drying with heat | 5 |
| Comparative Example 2 | Ink 1 | Processing fluid 1 | Discharging | Processing fluid | Drying with heat | Irradiation | 5 |
| Comparative Example 3 | Ink 1 | Processing fluid 1 | Discharging | Drying with heat | Processing fluid | Irradiation | 5 |
| Comparative Example 4 | Ink 2 | Processing fluid 1 | Discharging | Irradiation | Processing fluid | Drying with heat | 5 |
| Comparative Example 5 | Ink 1 | Processing fluid 1 | Discharging | — | Processing fluid | Drying with heat | — |
| Comparative Example 6 | Ink 1 | — | Discharging | Irradiation | — | Drying with heat | 5 |
| Comparative Example 7 | Ink 1 | Processing fluid 1 | Discharging | Irradiation | Processing fluid | Drying with heat | 0.1 |
| Comparative Example 8 | Ink 1 | Processing fluid 1 | Discharging * | Irradiation | Processing fluid | Drying with heat | 0.1 |
| Comparative Example 9 | Ink 1 | Processing fluid 1 | Discharging | Irradiation | Processing fluid | Drying with heat | 20 |

| | Ink | Processing fluid | Intensity of lamp ($W/cm^2$) | Integral of light ($mJ/cm^2$) | Drying temperature (degrees C.) | Wind speed (m/s) during drying | Total time (s) | Swelling ratio (percent) | Contact angle (degrees) |
|---|---|---|---|---|---|---|---|---|---|
| Comparative Example 1 | Ink 1 | Processing fluid 1 | 3.7 | 352 | 70 | 10 | 12 | 1 | 14 |
| Comparative Example 2 | Ink 1 | Processing fluid 1 | 3.7 | 352 | 70 | 10 | 12 | 1 | 14 |
| Comparative Example 3 | Ink 1 | Processing fluid 1 | 3.7 | 352 | 70 | 10 | 12 | 1 | 14 |
| Comparative Example 4 | Ink 2 | Processing fluid 1 | 3.7 | 352 | 70 | 10 | 12 | — | 14 |
| Comparative Example 5 | Ink 1 | Processing fluid 1 | — | — | 70 | 10 | 6 | 1 | 14 |
| Comparative Example 6 | Ink 1 | — | 3.7 | 352 | 70 | 10 | 11 | — | — |

TABLE 3-continued

| | | | | | | | | | |
|---|---|---|---|---|---|---|---|---|---|
| Comparative Example 7 | Ink 1 | Processing fluid 1 | 3.7 | 352 | 70 | 10 | 83 | 1 | 14 |
| Comparative Example 8 | Ink 1 | Processing fluid 1 | 3.7 | 352 | 70 | 10 | 7 | 1 | 14 |
| Comparative Example 9 | Ink 1 | Processing fluid 1 | 3.7 | 352 | 70 | 10 | 27 | 1 | 14 |

TABLE 4

| | Productivity | Image robustness | Blurring | Glossiness |
|---|---|---|---|---|
| Example 1 | A | A | A | A |
| Example 2 | A | B | A | A |
| Example 3 | A | A | B | A |
| Example 4 | B | A | C | A |
| Example 5 | A | C | A | A |
| Example 6 | A | A | A | C |
| Example 7 | A | A | A | B |
| Example 8 | A | A | B | A |
| Example 9 | A | A | C | A |
| Example 10 | A | A | B | A |
| Example 11 | A | B | A | A |
| Example 12 | A | C | A | A |
| Example 13 | A | B | B | A |
| Example 14 | B | A | A | A |
| Example 15 | A | C | B | A |
| Example 16 | A | A | A | B |
| Example 17 | A | B | A | A |
| Example 18 | A | A | A | C |
| Comparative Example 1 | A | D | D | A |
| Comparative Example 2 | A | A | D | A |
| Comparative Example 3 | A | A | D | A |
| Comparative Example 4 | A | D | D | A |
| Comparative Example 5 | A | D | D | A |
| Comparative Example 6 | A | D | A | D |
| Comparative Example 7 | D | C | A | B |
| Comparative Example 8 | A | C | D | B |
| Comparative Example 9 | C | A | D | A |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming method comprising:

discharging ink comprising water, a coloring material, a polymerization initiator, and a polymerizable compound to a recording medium by a line head to obtain an image;

exposing the image to active energy radiation;

applying a processing fluid to the image; and drying the image with heat, wherein a time interval between when the ink is discharged in the discharging from the line head to the recording medium passing under a bottom portion of the line head and when the recording medium is exposed to the active energy radiation in the exposing is from 0.5 to 15 seconds.

2. The image forming method according to claim 1, wherein the processing fluid comprises a resin emulsion in which resin particles are dispersed in water.

3. The image forming method according to claim 2, wherein the resin particles have a median particle diameter (D50) of 200 nm or less.

4. The image forming method according to claim 2, wherein the resin emulsion has a glass transition temperature (Tg) of 20 degrees C. or higher, which is lower than a drying temperature in the drying.

5. The image forming method according to claim 1, wherein an ink film prepared by the following method has a swelling ratio of 30 percent or less after the ink film is dipped in the processing fluid at 100 degrees C. for one hour, the swelling ratio being obtained by the following relationship, $$\text{Swelling ratio}=\{(\text{mass after dipping})-(\text{mass before dipping})\}/(\text{mass before dipping})\times 100$$

Method 5.0 g of the ink is placed in a Teflon™ Petri dish having a diameter of 50 mm and exposed to UV radiation at an integral of light of 17 mJ/cm$^2$ followed by drying at 100 degrees C. for 12 hours.

6. The image forming method according to claim 1, wherein an ink film prepared by the following method has a contact angle of 30 degrees or less 5 seconds after a drop of the processing fluid is deposited onto the ink film, Method 5.0 g of the ink is placed in a Teflon™ Petri dish having a diameter of 50 mm and exposed to UV radiation at an integral of light of 17 mJ/cm$^2$ followed by drying at 100 degrees C. for 12 hours.

7. The image forming method according to claim 1, wherein, in the exposing, the image is exposed to UV-A at an integral of light of from 17 to 2,000 mJ/cm$^2$.

8. The image forming method according to claim 1, wherein, in the drying, the image is dried by a heated wind heater.

9. The image forming method according to claim 8, wherein heated wind of the heated wind heater has a temperature of from 50 to 150 degrees C. and a wind speed of from 5 to 20 m/s at a position of the recording medium.

10. The image forming method according to claim 1, wherein, in the applying, the processing fluid is applied to the recording medium with a roller in a contact manner.

11. The image forming method according to claim 10, wherein the roller rotates forward in accordance with a conveyance direction of the recording medium.

* * * * *